US005309058A

United States Patent [19]

Heindl et al.

[11] Patent Number: 5,309,058

[45] Date of Patent: May 3, 1994

[54] SEAL CONSTRUCTION ARRANGEMENT FOR AN ELECTRODELESS HIGH INTENSITY DISCHARGE LAMP

[75] Inventors: Raymond A. Heindl, Euclid; Lawrence T. Mazza, Mayfield Heights; Gene I. Thomasson, Chesterland; Edward V. Parillo, South Euclid, all of Ohio

[73] Assignee: General Electric Company, Schenectady, N.Y.

[21] Appl. No.: 845,415

[22] Filed: Mar. 3, 1992

[51] Int. Cl.[5] ..... H01J 65/04

[52] U.S. Cl. ..... 313/25; 313/638; 313/607; 313/608; 315/248; 315/344

[58] Field of Search ..... 313/25, 607, 608, 153, 313/160, 161, 638; 315/248, 344

[56] References Cited

U.S. PATENT DOCUMENTS

| | | | |
|---|---|---|---|
| 2,975,330 | 3/1961 | Bloon et al. | 315/248 |
| 5,150,015 | 9/1992 | Heindl et al. | 315/248 |
| 5,151,633 | 9/1992 | Farrall et al. | 315/248 |

*Primary Examiner*—Donald J. Yusko
*Assistant Examiner*—Nimesh Patel
*Attorney, Agent, or Firm*—George E. Hawranko; Stanley C. Corwin

[57] ABSTRACT

An electrodeless HID lamp having a quartz arc tube having a gas fill contained therein, is energized to a discharge state upon the introduction of a high frequency RF current in close proximity thereto, also includes a starting aid stem which extends from the arc tube. An outer jacket surrounds the arc tube and a portion of the starting aid stem. The outer jacket is pinch sealed at the end from which the starting aid stem extends. This pinch sealing results in the formation of a sealed space between the outer jacket and the arc tube and further allows that, by the gripping of the starting aid stem at the pinch seal region, the arc tube is supported in a fixed non-contacting position within the outer jacket. A sealant material can be applied around the starting aid stem at the pinch seal region to prevent leakage of the sealed space formed within the outer jacket.

12 Claims, 3 Drawing Sheets

SEAL CONSTRUCTION ARRANGEMENT FOR AN ELECTRODELESS HIGH INTENSITY DISCHARGE LAMP

FIELD OF THE INVENTION

This invention relates to a seal construction arrangement for an electrodeless high intensity discharge lamp. More particularly, this invention relates to such a seal construction arrangement wherein a quartz arc tube having a quartz starting chamber extending therefrom is supported within a quartz outer jacket by means of a pinch seal arrangement and further wherein the pinch seal is effective for sealing the chamber formed between the outer jacket and the arc tube.

BACKGROUND OF THE INVENTION

For an electrodeless high intensity discharge (HID) lamp, it is known that the principles of operation by which improved operating characteristics including high efficacy and good color rendering can be achieved, also yields the advantage that, in the absence of metal to glass seals as found in an electroded discharge lamp, the operating life of the discharge lamp can be greatly extended. U.S. Pat. No. 4,810,938 issued to Johnson et al on Mar. 7, 1989 and assigned to the same assignee as the present invention, describes an electrodeless HID lamp which is inductively driven by a high frequency RF current to produce a toroidally shaped arc discharge within an arc tube associated with the HID lamp. The arc tube can be ellipsoidally shaped and will contain a gas fill which comprises a combination of sodium halide and cerium halide along with xenon gas in proper weight proportions to generate the white color lamp emission which exhibits the improved efficacy and color rendering properties. U.S. Pat. No. 4,810,938 is hereby incorporated by reference.

One of the design considerations in improving the commercial practicability of the electrodeless HID lamp is the provision of a starting aid for assisting in initiating the arc discharge within the arc tube. An example of a starting aid for an electrodeless HID lamp can be found in U.S. Pat. No. 5,140,227 issued to Dakin et al on Aug. 18, 1992 and assigned to the same assignee as the present invention, such patent application being hereby incorporated by reference. In this patent application, it is disclosed that a starting aid stem, constructed of quartz, is formed in an extending manner from the arc tube. A gaseous fill contained within the starting aid stem is excited to an electric discharge state upon the introduction of a starting current thereto. The starting current is introduced to the starting aid stem by means of an electrical connection capacitively coupled to the upper end of the starting aid stem at a point beyond where the quartz starting aid stem exits an outer jacket associated with the electrodeless HID lamp. The outer jacket is formed around the arc tube entirely and also around a portion of the starting aid stem. Furthermore, the outer jacket is also constructed of quartz.

In disposing the outer jacket around the arc tube and a portion of the starting aid stem, one can achieve several benefits including: protecting against physical damage to the arc tube, protecting against surface contamination of the arc tube that could otherwise cause devitrification of the quartz material, and, preventing hydrogen, oxygen or water vapor from the ambient air from diffusing into the arc chamber thereby adversely affecting the gas mixture therein. One example of an electrodeless HID lamp which utilizes an outer jacket over the arc tube can be found in the previously cited U.S. Pat. No. 4,810,938. Though shown as having a protective outer jacket, such an approach is impractical for the electrodeless HID lamp which utilizes a starting aid stem extending from the arc tube. In such a construction, it is necessary to have a seal between the outer jacket and the portion of the starting aid stem which exits the outer jacket.

One way to seal between a quartz outer jacket and a quartz starting aid stem is by means of a flared seal. A flared seal is one in which an outwardly flared opening formed on the starting aid stem is formed to a sufficiently large dimension so as to extend over the edges of a cylindrically shaped outer jacket thereby allowing the overlap portion to serve as a sealing means to the space formed between the outer jacket and the arc tube. Such an arrangement has proven effective when the stem member need only be flared out to twice its normal diameter, however, when a factor of five flaring is needed as in the present instance, the stem member may be unnecessarily stressed by this flare seal process. An example of an electrodeless HID lamp which utilizes one type of a flared seal between the outer jacket and the starting aid stem can be found in U.S. Pat. No. 5,150,015 issued to R. A. Heindl et al on Sep. 22, 1992 and assigned to the same assignee as the present invention. With such a flared seal, it has been found that the process for implementing such a seal to an acceptable performance level in a mass production environment requires a time consuming and relatively difficult manufacturing process. For a product intended for mass production manufacturing techniques, it would be advantageous to utilize a sealing process that could be performed using automated equipment rather than the manual process used for the flared seal. Accordingly, though the flared seal arrangement is appropriate for a design stage of a lamp product such as an electrodeless HID lamp, when it is necessary to enter into a high volume production mode of operation, the flared seal approach is impractical.

An alternative to the flared seal arrangement can be found in a conventional electroded lighting product which utilizes a pinch seal to seal the arc tube around the electrode leads which extend through the ends of the arc tube. An example of a lamp using a pinch seal arrangement for sealing lamp lead-in wires within an end region of a lamp envelope can be found in U.S. Pat. No. 4,916,353 issued to Danko et al on Apr. 10, 1990 and assigned to the same assignee as the present invention. In this patent, an inner light transmissive cylinder is sealed within the lamp envelope thereby achieving a second glass or quartz structure within a lamp envelope. Though such a lamp illustrates one glass or quartz structure sealed within another, this lamp utilizes a metal lead-in wire to support the inner quartz cylinder and moreover, such inner cylinder is not joined to the lamp envelope at the point where the pinch seal is performed. With an electrodeless HID lamp, and particularly one which exhibits the quartz starting aid stem of the present invention, it is necessary to both seal the space within the outer jacket which surrounds the arc tube and to support the arc tube within the outer jacket. Furthermore, each of these functions must be accomplished without the benefit of the support that a lead-in wire arrangement can provide as in the instance of the electroded lamp. Of course, it is understood from the incorporated U.S. Pat. No. 4,810,938 that an electrodeless HID lamp provides the advantages of eliminating the glass to metal seals which are responsible for a shorter lamp life caused by the deficiency in seal integrity inherent in a glass to metal seal and that the electrodes are no longer involved in the discharge process.

Therefore, it would be advantageous to provide an electrodeless HID lamp having a starting tube extending from the arc chamber and an outer jacket which surrounds the arc chamber and at least a portion of the starting tube wherein the seal between the outer jacket and the extending starting tube constructed of the same materials achieved a high degree of seal integrity and could be implemented on a mass production manufacturing basis.

With respect to the process of sealing quartz material lamp products, it is customary to heat the quartz tube using oxygen-hydrogen or oxygen-natural gas fires, plasma flames or laser beams to a temperature at which the quartz becomes softened; the softened quartz is then pressed or pinched to form a hermetic seal at the end of the quartz tube. The typical application of such a process applies to a lamp product which utilizes a lead in wire. An example of a patent which addresses the problem of a leaky seal in the pinch seal region of the lead-in wire can be found in U.S. Pat. No. 3,868,528 issued to Lake et al on Feb. 25, 1975 and issued to the same assignee as the present invention. This patent discusses the fact that voids formed in the sealing process between an arc tube and a tungsten electrode can be filled using a glass sealant. This approach has proven effective in a lamp product having a tungsten electrode where, since the tungsten has a much greater coefficient of thermal expansion than the quartz material of the arc tube, crevices or gaps would inevitably form where the tungsten electrode extends into the quartz envelope without the use of the layer of sealing glass between the tungsten and quartz. Though this approach has proven effective for electroded discharge lamps, the step of coating the tungsten shank with a layer of glass sealant is not one available in the non-electroded quartz to quartz seal region associated with the electrodeless HID lamp of the present invention.

SUMMARY OF THE INVENTION

The present invention provides for an electrodeless high intensity discharge lamp which achieves a positive seal for a chamber which surrounds the arc tube in which the arc discharge occurs and moreover, does so in a manner that avoids the use of metallic components either for electrical connection or mechanical support and also can be implemented in a mass production environment that allows for manufacturing production levels sufficient to meet commercial demands. In addition to merely sealing the chamber surrounding the arc tube, the sealing arrangement of the present invention is also effective for supporting the arc tube within an outer jacket without contact occurring between the outer jacket and the arc tube. The support of the arc tube, accomplished with the non-contacting assistance of the outer jacket, occurs through use of a starting aid stem which serves the dual purpose of providing a means for starting the arc discharge within the arc tube and for indirectly supporting the arc tube within the outer jacket in a non-contacting relation between the arc tube and the outer jacket.

In accordance with the principles of the present invention, there is provided an electrodeless HID lamp which comprises an arc tube having a gas fill disposed therein and wherein the gas fill is excitable to an arc discharge state upon the introduction of high frequency RF energy in the near proximity to the arc tube. A starting aid stem, connected to the arc tube and extending outwardly therefrom, also includes a gas fill which is energizable to a discharge state in response to a starting current applied to a portion of the starting aid stem at a distance from the arc tube. An outer jacket disposed in non-supporting surrounding relation to the arc tube also surrounds a portion of the starting aid stem while having an opening through which a second portion of the starting aid extends externally of the outer jacket. A sealing arrangement is formed at the point where the starting aid stem exits the outer jacket and is effective for sealing the space formed between the arc tube and the outer jacket. The sealing arrangement is further effective, through a press seal arrangement between the starting aid stem and the portion of the outer jacket where such starting aid stem exits, for supporting the arc tube within the outer jacket in a non-contacting manner. In this manner, the outer jacket further supports the arc tube indirectly and without contacting the arc tube thereby insuring that any thermal connection between the arc tube and the outer jacket is avoided.

In another embodiment of the present invention, it is possible to insure the integrity of the sealing operation at the quartz to quartz region between the starting aid stem and the outer jacket region where the pinch seal occurs by use of a small amount of glass powder at the sides of the starting aid stem at the time of pinch sealing.

A further embodiment of the invention allows for the use of a hollow or possibly solid stem rather than a gas filled one; in this manner, the arc tube would still be supported within the outer jacket by means of the pinch seal between the outer jacket and the stem. It is even contemplated that merely the support of the arc tube within the outer jacket by means of the pinch seal provides an advantage over known approaches.

DETAILED DESCRIPTION OF THE INVENTION

Figure 1:
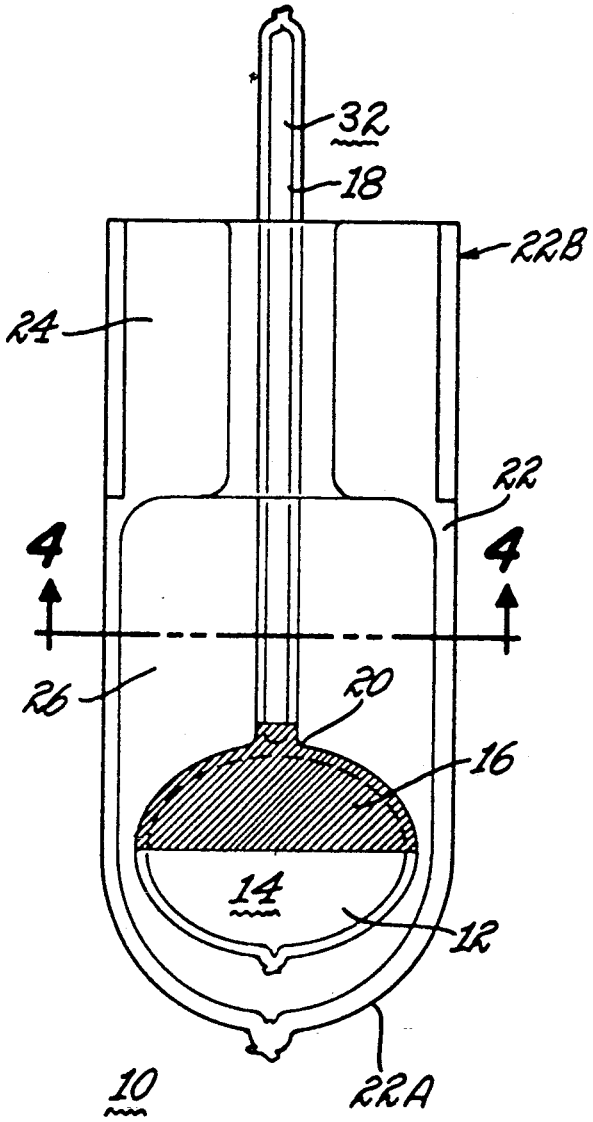
FIG. 1 is a cross-sectional side view of an electrodeless HID lamp having a sealing arrangement constructed in accordance with the present invention.

As seen in FIG. 1, the electrodeless HID lamp 10 of the present invention includes an arc tube 12 in which is contained a fill 14. The arc tube 12 may be of a generally ellipsoidal shape and, as discussed in the aforementioned U.S. Pat. No. 4,810,938, the fill 14 will include a sodium halide, a cerium halide and xenon in proper weight proportions to generate a white color lamp emission exhibiting improved efficacy and color rendering properties which are characteristic of the electrodeless HID lamp of the present invention. An arc discharge having a generally toroidal shape is excited in fill 14 by means of an induced current flowing through the arc tube. A ballast circuit (not shown) for generating the induced current can be found in U.S. Pat. No. 4,812,702 which issued to J. M. Anderson on Mar. 14, 1989 and is assigned to the same assignee as the present invention, U.S. Pat. No. 4,812,702 being hereby incorporated by reference. The RF current generated by the ballast circuit of this incorporated patent results in a time-varying magnetic field which produces within the arc tube 12, a solenoidal electric field which substantially closes upon itself. As a result of this solenoidal electric field produced within the arc tube 12, a toroidally shaped arc discharge is produced in the fill 14. A reflective coating 16 may be disposed over a portion of the arc tube 12 to serve as a means to more efficiently direct the light output of the electrodeless HID lamp 10.

A starting aid stem 18 is connected to the arc tube 12 in a manner so that a common wall 20 exists between one end of the starting aid stem 18 and a portion of the outer surface of the arc tube 12. The operation of the starting aid stem 18 in conjunction with the arc tube 12, is discussed in the incorporated U.S. Pat. No. 5,140,227. The second gas fill 32 contained in the starting aid stem 18 is excitable to a discharge state upon the coupling of a starting current thereto. The starting aid stem 18 and the arc tube 12 are constructed of like non-metallic materials and preferably, are both constructed of a fused quartz material. Additionally, regarding the shape of the starting aid stem 18, although shown in an extending tubular form, other shapes of the starting aid stem 18 are contemplated by the present invention. For instance, the starting aid stem 18 could be provided in the shape of a smaller ellipsoidally shaped chamber disposed in adjacent relation to the arc tube 12.

It is also contemplated by the present invention that the starting aid stem 18 can be hollow and/or solid as opposed to having the second fill 32 disposed therein. The primary purpose of a hollow or solid stem would remain fulfilled in that the arc tube 12 would still be supported by such solid/hollow stem. For purposes of serving as a starting aid, it would be possible to insert a starting rod into the hollow stem so as to be in close proximity to shared wall 20. In such a configuration, the upper end of the hollow stem would remain open so that the starting rod could be inserted without the need of a glass-to-metal seal between the starting aid stem 18 and arc tube 12.

As further seen in FIG. 1, the structure which comprises the arc tube 12 and the connected starting aid stem 18 is fitted within an outer jacket 22. The outer jacket 22 is also constructed of the like non-metallic material from which the arc tube 12 and starting aid stem 18 are formed. Additionally, the outer jacket 22 is in a shape such that one end substantially conforms to a significant portion of the surface area of the arc tube 12 and resides in a close yet non-contacting relation to the arc tube 12. In this manner, it can be appreciated that the coil member (not shown) through which the RF energy is inductively coupled to the gas fill 14 can be placed in as close a proximity to the arc tube 12 as possible. It is also possible to extend the outer jacket 22 below the arc tube 12 while still maintaining the close proximate relation between the sides of the arc tube 12 and the outer jacket 22 that are desirable for coupling RF energy in an efficient manner. It is known that minimizing the gap between the coil member and the arc tube 12 improves the inductive coupling to the arc tube 12. However, allowing the arc tube 12 to touch the outer jacket 22 would be detrimental to lamp performance since unpredictable thermal losses would result.

With the arc tube 12 residing at the end 22A of the outer jacket 22 may be shaped in conformance to the bottom hemisphere of the arc tube 12, the starting aid stem 18 will extend through the opposite end 22B of the outer jacket 22 so that a portion of the starting aid stem 18 extends past the opposite end 22B. This portion of the starting aid stem 18 extending beyond the outer jacket 22 is effective for coupling starting current to the starting aid stem 18; in this manner, the energization of the arc tube 12 is accomplished without the use of metallic, conducting components.

The end 22B of the outer jacket 22 through which the starting aid stem 18 extends is sealed using a pinch or press seal operation which thereby results in a press seal region 24 of the outer jacket 22. As seen in FIG. 1, the press seal region 24 surrounds a portion of the starting aid stem 18 and is further effective for creating a hermetically sealed space 26 between the outer jacket 22 and the arc tube 12. By use of this press or pinch seal operation, the manufacture of the electrodeless HID lamp 10 can be accomplished using automated high speed equipment similar to that used for conventional electroded arc tubes. The pinch seal operation, in addition to resulting in the formation of the sealed space 26, serves the further purpose of mechanically supporting the arc tube 12 within the outer jacket 22. The support achieved by way of the pinch seal 24 gripping a portion of the starting aid stem 18 must be accurate so as to maintain the uniform spacing between the arc tube 12 and the outer jacket 22 in the close proximate relation previously discussed. It is further contemplated that in the absence of the need to have a sealed space 26 between the arc tube 12 and outer jacket 22, a significant advantage is achieved by the supporting function performed by the pinch seal 24. It is further contemplated as being within the scope of the present invention that for purpose of achieving the support of the arc tube 12 within the outer jacket 12, more than one stem 18 could be pinch sealed into the pinch seal region 24.

Figure 2:
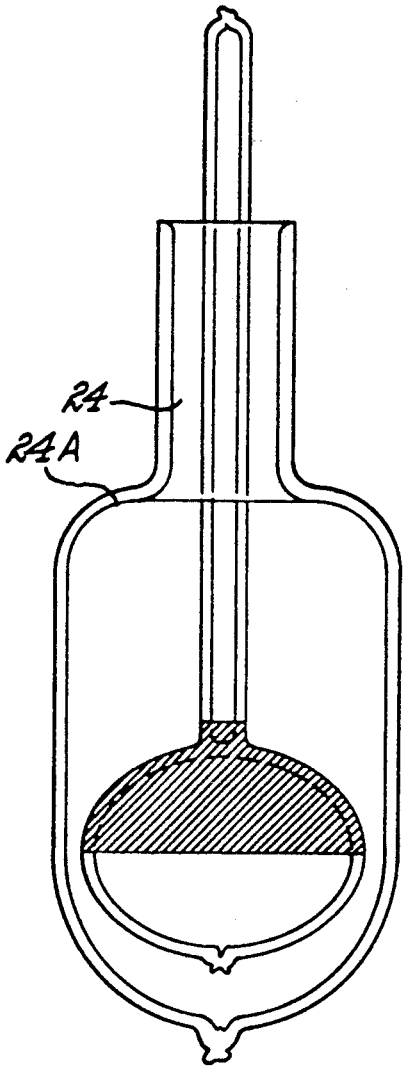
FIG. 2 is a cross-sectional side view of the electrodeless HID lamp of FIG. 1 rotated 90 degrees about the longitudinal axis of the lamp.

The electrodeless HID lamp 10 as shown in FIG. 2 exhibits a molded contour at the pinch seal region 24. It may be possible that in the implementation of the electrodeless HID lamp 10 of the present invention in a light fixture (not shown) , this molded contour of the pinch seal region 24 would serve as a means for holding the lamp 10 in the fixture. It can also be appreciated from the representation of the electrodeless HID lamp 10 as shown in FIG. 2 that, in the absence of the reflective coating 16 on the arc tube 12, light output could occur in the upward direction through the transition portion 24A formed on the pinch seal region 24.

Figure 3:
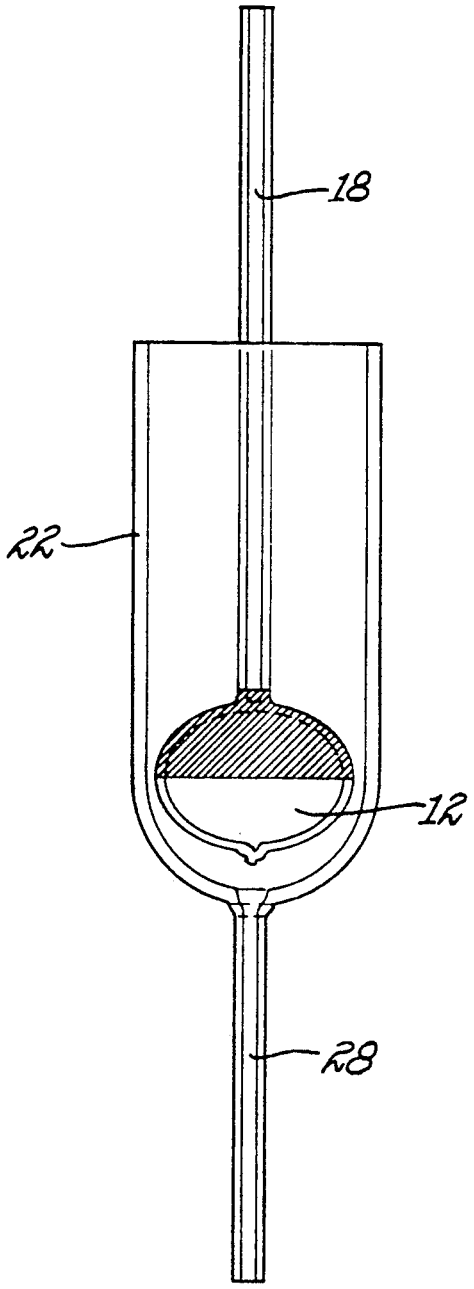
FIG. 3 is a cross-sectional side view of an electrodeless HID lamp in a condition prior to the manufacturing step of sealing the outer jacket.

As seen in FIG. 3, the electrodeless HID lamp 10, prior to undergoing the pinch seal operation which results in the formation of the pinch seal region 24, consists of the arc tube 12 and starting aid stem 18 structure which are fitted within the tubular shaped outer jacket member 22. In the assembly operation for the electrodeless HID lamp 10, it is critical that the arc tube 12 be maintained in a close but non-contacting relation to the outer jacket 22 throughout the process. In order to achieve this result, the pinching machine would rigidly support the starting aid stem 18 as well as the outer jacket 22 to insure that the arc tube is precisely aligned within the outer jacket 22. As an aid in achieving this precision alignment during the pinching operation, it can be seen that the starting aid stem 18 is connected to the arc tube 12 along its central axis and also that an exhaust tube 28 formed at the closed end 22A of the outer jacket 22 is connected at the central axis of the outer jacket 22. Such a configuration allows for the simple alignment of the outer jacket 22 with the arc tube 12 and starting aid stem 18 structure. Once the pinch seal operation has been performed, the sealed space 26 formed between the outer jacket 22 and the arc tube 12 can be evacuated through the exhaust tube 28 which is then sealed off using conventional means.

Figure 4:
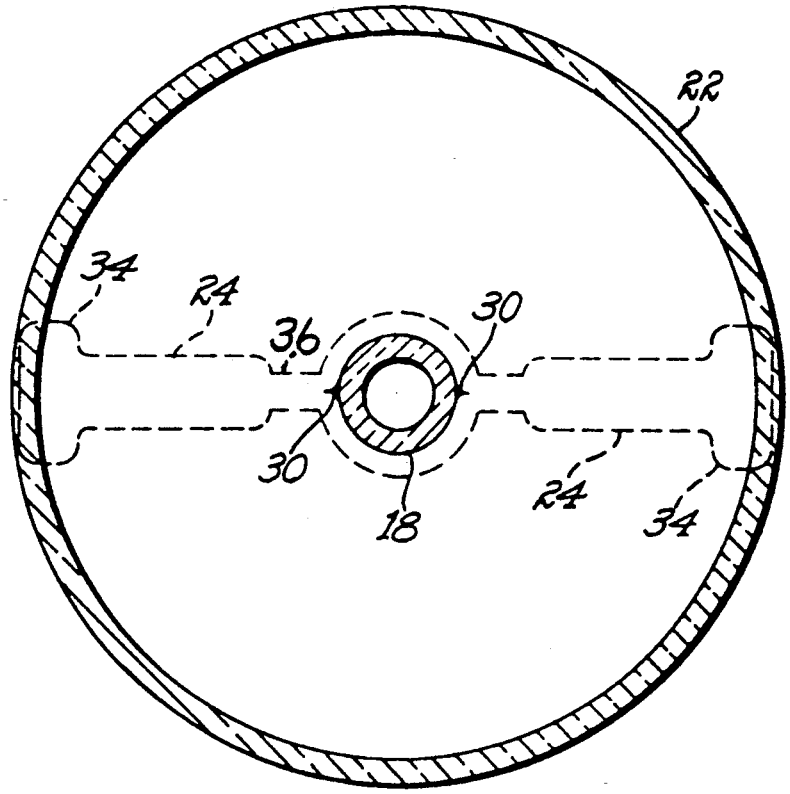
FIG. 4 is a cross-sectional view of an electrodeless HID lamp using a glass sealant at the pinch seal region and taken along lines 4—4 as shown in FIG. 1.

In the process of pinch sealing the open end 22B of the outer jacket 22 around the starting aid stem 18, a potential problem arises in that it is possible that the starting aid stem 18 could soften during the process. In order to avoid the problem of the starting aid stem 18 softening during the pinch seal process, it is proposed to blow a jet of cold gas into the starting aid stem 18 during the pinching process. As an alternative measure for preventing the softening of the starting aid stem 18 during the pinching process, the wall thickness of the starting aid stem 18 can be made greater than the wall thickness of the outer jacket 22 as is shown in FIG. 4. In this manner, the thermal inertia of the starting aid stem 18 would be sufficiently high so as to prevent softening during the short time between closing the pinch jaws and cooling of the pinched quartz below the softening point. Yet another approach to alleviating any problems caused by the starting aid stem 18 softening during the pinching process is to temporarily insert a tungsten or other refractory metal rod into the stem 18 so that it would be supported in the event that it did soften.

As further seen in FIG. 4, extending from the starting aid stem 18 in diametrically opposing directions toward the pinch seal region 24 are sealant members 30. Hermetically pinch sealing the large diameter quartz starting aid stem 18 within the similar material construction of the outer jacket 22 could result in a gap or a crevice being formed on either side of the starting aid stem 18. This is due to the fact that the high viscosity exhibited by the softened quartz inhibits the flow and wetting of the starting aid stem 18 to the pinch seal region 24 thus resulting in the probability of a leaky seal. This leaky seal is prevented by the use of sealant members 30 which are comprised of a lower-melting glass (relative to the fused quartz material of the stem 18 and outer jacket 22). The lower-melting glass insures complete filling of any crevices that may form at the sides of the starting aid stem 18 during the pinch sealing operation. The material utilized for glass sealants 30 must be a close match in terms of the thermal expansion coefficient in relation to the starting aid stem 18 and outer jacket 22. The lower-melting glass of the sealant members 30 can be provided by the use of a glass powder such as G.S.C. #1 (Graded Seal Cane #1). The glass powder is applied to the sides of the starting aid stem 18 prior to making the pinch seal. During heating of the quartz to its softening point and the subsequent pinching of the quartz outer jacket 22 at the pinch seal region, the glass powder softens to a lower viscosity than the quartz material, and as a result, flows into the crevices to form the sealant members 30. Although it has been found that the G.S.C. #1 works well as the material of the sealant members 30, it is contemplated that other materials having a lower viscosity property than quartz would be equally effective and are therefore within the scope of the present invention.

As further seen in FIG. 4, in the process of pinch sealing the outer jacket 22, the pinch seal region will exhibit an outward flange 34 on either side of the seal. Outer flanges 34 occur by way of using a confined pinch seal process; that is, in a confined pinch seal arrangement, the excess material resulting from the pinch cannot extend beyond the perimeter of the outer jacket 22 and therefore results in flanges 34 being formed. It will also be noted that the pinch seal process of the present invention provides for indentions 36 formed near the starting aid stem 18. Indentions 36 are formed by the pinch jaws (not shown) and are effective for insuring a proper seal around the starting aid stem 18.

Although the hereinabove described embodiment of the invention constitutes the preferred embodiment, it should be understood that modifications can be made thereto without departing from the scope of the present invention as set forth in the appended claims.

We claim:

1. An electrodeless discharge lamp comprising:

an arc tube having a gas fill disposed therein, said gas fill being excitable to a discharge state;

a starting aid stem connected to said arc tube and extending outwardly therefrom, said starting aid stem having a second gas fill disposed therein, said second gas fill being excitable to a discharge state;

an outer jacket disposed in a non-supporting surrounding relation to said arc tube and further being disposed in surrounding relation to at least a portion of said starting aid stem, said outer jacket having an opening through which a second portion of said starting aid stem extends; and sealing means formed on said outer jacket adjacent said opening and effective for sealing a space formed between said outer jacket and said arc tube, said sealing means being further effective for gripping said starting aid stem as said starting aid stem exits said outer jacket and supporting said starting aid stem and arc tube in a fixed position within said outer jacket thereby.

2. An electrodeless discharge lamp as set forth in claim 1 wherein said outer jacket and starting aid stem are constructed of like non-metallic materials.

3. An electrodeless discharge lamp as set forth in claim 1 wherein said starting current is coupled to an area on said starting aid stem most distant from said arc tube, said area of coupling being external of said outer jacket.

4. An electrodeless discharge lamp as set forth in claim 1 wherein said sealing means is a pinch seal portion formed on said outer jacket at an end in which said opening is formed and at which end said second portion of said starting aid stem extends therefrom, said pinch seal portion completely surrounding the portion of said starting aid stem near said opening.

5. An electrodeless discharge lamp as set forth in claim 4 wherein said sealing means further includes an intermediate coating disposed between said starting aid stem and said outer jacket in the area of said pinch seal portion, said intermediate coating being of a non-magnetic, non-conductive material other than quartz and said intermediate coating further having associated therewith, a lower viscosity characteristic than quartz when heated.

6. An electrodeless discharge lamp as set forth in claim 5 wherein said intermediate coating is a glass powder having low melting point characteristics relative to quartz.

7. An electrodeless discharge lamp as set forth in claim 4 wherein said starting aid stem is constructed of a like non-metallic material as said outer jacket and further wherein said starting aid stem is constructed in a manner so as to achieve a thicker wall dimension than said outer jacket.

8. An electrodeless discharge lamp as set forth in claim 4 wherein said arc tube is supported within said outer jacket by said sealing means in a manner such that said arc tube is in close proximity to said outer jacket and yet avoids contact with said outer jacket and further wherein said arc tube is supported within said outer jacket at a second end thereof, said second end of said outer jacket being opposite said end of said outer jacket in which said opening is formed.

9. An electrodeless discharge lamp as set forth in claim 8 wherein said starting aid stem extends from said arc tube along the center axis of said arc tube and further wherein said exhaust tube is formed along the center axis of said outer jacket, said exhaust tube and said starting aid stem thereby being axially aligned so that said arc tube can be centered within said outer jacket.

10. An electrodeless discharge lamp as set forth in claim 6 wherein said intermediate coating has a thermal expansion coefficient similar to that associated with said outer jacket and said starting aid stem.

11. An electrodeless discharge lamp comprising:

an arc tube having a gas fill disposed therein, said gas fill being excitable to a discharge state upon introduction of an excitation current in proximity thereto;

a stem connected to said arc tube and extending therefrom;

an outer jacket disposed in a non-supporting surrounding relation to said arc tube and to at least a portion of said stem, said outer jacket having an opening through which a second portion of said stem extends; and supporting means formed on said outer jacket adjacent said opening and being effective for gripping said stem as said stem exits said outer jacket and supporting said stem and arc tube in a fixed position within said outer jacket thereby.

12. An electrodeless discharge lamp as set forth in claim 11 wherein said supporting means includes a pinch seal region formed at said opening in such a manner as to grip said stem thereby.

* * * * *